US005770148A

United States Patent [19]

Leiner et al.

[11] Patent Number: 5,770,148

[45] Date of Patent: Jun. 23, 1998

[54] METHOD AND APPARATUS FOR THE DEACIDIFICATION OF LIBRARY MATERIALS

[75] Inventors: Lee H. Leiner, New Kensington; James E. Burd, Saxonburg, both of Pa.

[73] Assignee: Preservation Technologies, L.P., Cranberry Township, Pa.

[21] Appl. No.: 586,252

[22] Filed: Jan. 16, 1996

[51] Int. Cl.[6] ..... B01J 19/00

[52] U.S. Cl. ..... 422/40; 427/439

[58] Field of Search ..... 422/40, 292, 295; 427/600, 439

[56] References Cited

U.S. PATENT DOCUMENTS

| | | | |
|---|---|---|---|
| 4,051,276 | 9/1977 | Williams et al. | 427/395 |
| 4,544,843 | 10/1985 | Kundrot . | |
| 4,860,685 | 8/1989 | Smith | 427/421 |
| 5,120,500 | 6/1992 | Eggersdorfer et al. | 422/40 |
| 5,137,760 | 8/1992 | Lundquist | 422/40 |
| 5,264,243 | 11/1993 | Wedinger et al. | 422/40 |
| 5,409,736 | 4/1995 | Leiner et al. . | |
| 5,422,147 | 6/1995 | Leiner et al. | 427/439 |
| 5,527,516 | 6/1996 | Yamamoto et al. | 422/292 |

*Primary Examiner*—Peter A. Hruskoci
*Assistant Examiner*—Betsey J. Morrison
*Attorney, Agent, or Firm*—Kirkpatrick & Lockhart LLP

[57] ABSTRACT

A method and apparatus are provided for deacidifying cellulose based materials, especially books, magazines, and other bound or folded cellulose materials having a spine. The method includes contacting the materials with a treating medium and producing relative movement at a predetermined velocity between the materials and the treating medium in a direction generally parallel to the spine of the materials and, preferably simultaneously, directing the treating medium by means of a spray toward the materials in a direction generally perpendicular to the spine of the material for a period of time effective for the treating medium to contact substantially all of the material. Following treatment, any excess treating medium is removed from the material and directing any such removed treating medium to a holding tank for reuse later. The movement in a parallel direction is achieved by reciprocating the materials through a tank filled with treating medium. In addition, the material may be rotated about a central axis of the treatment tank. The preferred embodiment of the present invention includes an apparatus consisting of a treating tank for containing the treating medium, a plurality of material holders disposed in the tank on a reciprocatable and rotatable shaft, and spray nozzles for producing the perpendicular movement of the treating medium relative to the spine of the material.

14 Claims, 5 Drawing Sheets

METHOD AND APPARATUS FOR THE DEACIDIFICATION OF LIBRARY MATERIALS

BACKGROUND OF THE INVENTION

1. Field of the Invention

The invention generally relates to a method and apparatus for contacting sheet-like material with a treating medium. More particularly, the invention relates to an improved method and apparatus for the deacidification of cellulose based materials such as books, magazines, newspapers, documents and the like.

2. Description of the Invention Background

The deterioration of paper, books and newspapers is well-known and a recognized threat to permanence of library and archival collections. The severity of the threat is dependent in large part on the type of cellulose and the manufacturing process used to produce the cellulose based material; however, numerous environmental factors, such as air pollution, exposure to natural and artificial light, microbiological attack, and physical handling also play a part in the deterioration. One of the most pervasive forms of deterioration is acidic attack of the cellulose structure by acidic species present in the cellulose material, which can shorten the useful life of paper products from centuries to years. The primary contributors to the presence of acidic species in the cellulose based material are the manufacturing processes used to make the cellulose material and air pollution.

Acidic attack of the cellulose material results in the breakdown of the cellulose structure, rendering the paper embrittled and discolored. Paper produced from wood pulp fiber is particularly susceptible to attack because in most instances the pulp fiber must be treated with various chemicals to produce the paper with the proper opacity and of sufficient quality for use. Many of the chemicals used in producing the paper are either acidic or are deposited by methods employing acids an residual amounts of the acidic species remain in the cellulose matrix of the finished paper product. The acidic attack of cellulose based materials is exacerbated by air pollution which, in essence, provides a perpetual source of chemicals, such a sulfur, nitrogen and carbon-based oxides, that can be hydrolyzed to form acids. The presence of these chemicals in the air threatens not only to worsen the attack of inherently acidic paper product but will, over time, produce acidic conditions in paper products that were initially alkaline or neutral. The accelerated deterioration resulting from air pollution is a significant long term concern in that many of the library and archival materials are located in urban areas and subject to high levels of industrial pollutants. Thus, prevention of paper deterioration by acidic attack is necessarily a bifurcated problem of neutralizing the acidic conditions that are currently present in the paper and of providing for the neutralization of acidic species that are introduced over time.

A significant amount of research has been devoted to developing chemicals and methods to neutralize the acidic species in cellulose based material and to provide an alkaline buffer so as to militate against the development of acidic conditions over time. A wide variety of processes have been developed using alkaline species to neutralize acidic species involving both liquid and vapor treatment techniques, for example U.S. Pat. No. 3,676,055 (magnesium methoxide and methanol); U.S. Pat. No. 3,676,182 (alkali carbonates and bicarbonates); and U.S. Pat. No. 3,969,549 (volatile metal alkyls). However, the chemicals and techniques of those processes all suffer from a number of drawbacks, such as toxicity, odor, high cost, reactivity with and solubility of various inks and paper, in addition to incomplete treatment of bound material despite the use of liquid immersion techniques.

U.S. Pat. No. 4,522,843 issued Jun. 11, 1985 to Kundrot discloses the use of dispersions of alkaline particles consisting of a basic metal oxide, hydroxide or salt carried by inert gas and liquid carriers, which overcomes many of the drawbacks of the prior art by providing alkaline species that do not form deleterious neutralization reaction products and that can be readily deposited to provide an alkaline reserve and liquid carriers that are inert with respect to a vast majority of inks, dyes and cellulose materials. Preferred embodiments of the Kundrot patent provide for a treating solution consisting of $MgO_2$ particles dispersed in chlorofluorocarbon (i.e. Freon) carrier. The unavailability of chlorofluorocarbon has rendered the practice of the Kundrot patent commercially unfeasible.

U.S. Pat. No. 5,409,736 issued Apr. 25, 1995 to Leiner et al., hereinafter the "'736 patent", discloses the use of perflourinated carriers and associated surfactants, in lieu of chlorofluorocarbon compounds used in the Kundrot method, as a suitable liquid carrier for the alkaline particles. The treating solution compositions and the methods disclosed by the '736 patent are used in conjunction with the present invention and are incorporated herein by reference.

The Kundrot patent discloses the use of spray nozzles oriented above a single submerged book and to direct a wide deflection spray vertically parallel to the spine of the book. The technique was not overly effective at contacting the are of the sheets near the center of the book, where the material is bound, sometimes referred to herein as the "gutter" of the bound material.

U.S. Pat. No. 5,422,147 issued Jun. 6, 1995 to Leiner et al., hereinafter the "'147 patent" disclosed a method and an apparatus that significantly improved the effectiveness of treating bound material. The inventors found that by causing relative parallel movement between the spine of the material and the treating medium a significant improvement can be achieved in both the extent of treatment per page and in reducing the page to page variation in the treatment. A preferred embodiment of the apparatus described in the '147 patent provides for the immersion of the cellulose materials in a treating medium followed by the production of relative movement between the liquid solvent and the cellulose material in a direction generally parallel to the spine of the material. The relative movement is produced by either movement of the cellulose material, the treating medium or both. Relative parallel movement is believed to assist in separating the sheets of the cellulose material to allow penetration of the treating medium. That movement also allows the treating medium to flow across the spine of bound material, thereby resulting in more complete coverage by the treating medium.

The commercial viability of a mass treatment method for deacidification or any other treatment depends on the ability of the process to fully treat the material in a manner that is both cost effective and timely. While the apparatus and process described in the '147 patent provide superior results in terms of the extent of deacidification and treatment time, the commercial viability and appeal of a mass deacidification procedure requires the development of ever more efficient and effective process and apparatuses to perform mass treatment of cellulose based material. Accordingly, it is an object of the present invention to provide an improved process and apparatus for the efficient and cost effective deacidification of cellulose based materials.

SUMMARY OF THE INVENTION

The above objectives and others are accomplished by a method and apparatus in accordance with the present invention. The apparatus of the present invention includes a tank for containing a treating fluid, a plurality of material holders disposed in the tank and structured for holding bound and folded material having a spine, a system for causing relative movement at a predetermined velocity between the materials and the fluid in a direction generally parallel to the spine of the materials when the materials are placed in the material holders, and means for exerting pressure against the materials sufficient to expose substantially the entirety of the materials to the fluid. The pressure is preferably exerted by directing fluid toward the material in a direction generally perpendicular to the spine of the material.

The fluid directing means preferably comprises a plurality of spray nozzles, each of which is positioned in the tank in a facing relationship relative to a different one of the plurality of material holders. The spray nozzles are preferably structured to direct spray in a generally flat arcuate pattern. The spray nozzles have a longitudinal slit therein directed along a line generally parallel to the central axis of the tank for directing the generally flat patterned spray toward the spine of the materials. The tank preferably includes an outlet line and the spray nozzles are preferably fluidly connected to the outlet line for draining fluid from the tank through the outlet line to the nozzles for reintroduction into the tank. The apparatus may also include a pump, a filter, a heater and means for preventing agglomeration of any particulate matter in the fluid, such as an ultrasonic generator, disposed along the outlet line between the tank and the spray nozzles.

The tank may have a variety of shapes, but is preferably cylindrical having a central longitudinal axis therethrough. The tank also may include a removable sealable lid. The material holders are preferably radially disposed about the central axis of the tank.

The system for causing movement between the materials and the fluid in a generally parallel direction may include a shaft disposed in the tank along the axis thereof on which are radially mounted the material holders, motor means, and a member operatively connected to the motor means for reciprocating the shaft along the axis of the tank at the predetermined velocity to effect movement of the materials in the generally parallel direction when the materials are placed in the material holders. The apparatus may further include means for producing relative movement between the fluid and the materials in a generally arcuate direction relative to the spine of the materials, such as means for rotating the material holders within the tank. There is therefore preferably provided a second motor means operatively connected to the shaft for imparting such rotational motion thereto.

The apparatus may also include means for drying the materials, either in a separate unit or in the treatment tank itself. The drying means may include a gas circulating drying system or a vacuum drying system. If the tank is the drying unit, the tank includes a drain to drain the treating fluid from the tank and direct it to a holding tank or a second treating tank before the drying stage begins.

The invention also includes a closed system comprising at least one treatment apparatus, a storage tank, means for transferring the treating fluid or medium to and from the storage tank and the treatment apparatus, means for drying the material following treatment, and means for recycling the treating fluid or medium removed from the material during drying and returning the removed treating fluid or medium to the storage tank. There may also be at least one second tank fluidly connected to the outlet line of the tank, valve means for controlling the flow of fluid from the outlet line to one of the second tank or the spray nozzles.

In use, material having a plurality of sheets with opposing surfaces and defining a spine, such as books, magazines, newspapers, documents and the like is placed in a tank containing the treating medium, relative movement is produced at a predetermined velocity between the materials and the treating medium in a direction generally parallel to the spine of the materials and the treating medium is also directed toward the material in a direction generally perpendicular to the spine of the material for a period of time effective for the treating medium and for contacting substantially all of the material. Excess treating medium is then removed from the material, preferably by drying with heated gas, such as air, or by vacuum drying.

The step of producing movement in a direction generally parallel to the spine of the materials may comprise placing the materials in the tank and flowing treating medium over the materials in a direction generally parallel to the spine of the materials. Alternatively, that step may be comprised of submerging the materials in a tank containing a volume of treating medium, and moving the materials through the treating medium in a direction parallel to the spine of the materials, for example, by reciprocating the materials in the parallel direction.

The step of directing the treating medium toward the material in a direction generally perpendicular to the spine of the material comprises spraying treating medium towards the materials from spray nozzles disposed in the tank and positioned in a facing relationship relative to the materials. The spray is preferably directed at a rate within the range of about 1.0 to less than 3.0 gallons per minute, preferably at about 40 psi. The spraying may occur simultaneously with and throughout the step of moving the materials in a direction parallel to the spine of the materials or may occur intermittently during the parallel moving step. Alternatively, the spraying may occur before the relative parallel movement step begins.

The method also preferably includes the step of rotating the materials during the step of moving the materials in a direction parallel to the spine of the materials to produce a partial helical motion. This step may occur simultaneously with the relative parallel movement for all or at least a portion of the period of time for treatment or at least during the period of spraying so that the rotation aids coverage of the spray over the materials.

Accordingly, the present invention provides an effective solution to problems heretofore encountered with mass deacidification of cellulose based materials. These advantages and others will become apparent from the following detailed description.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF PREFERRED EMBODIMENTS

Figure 3:
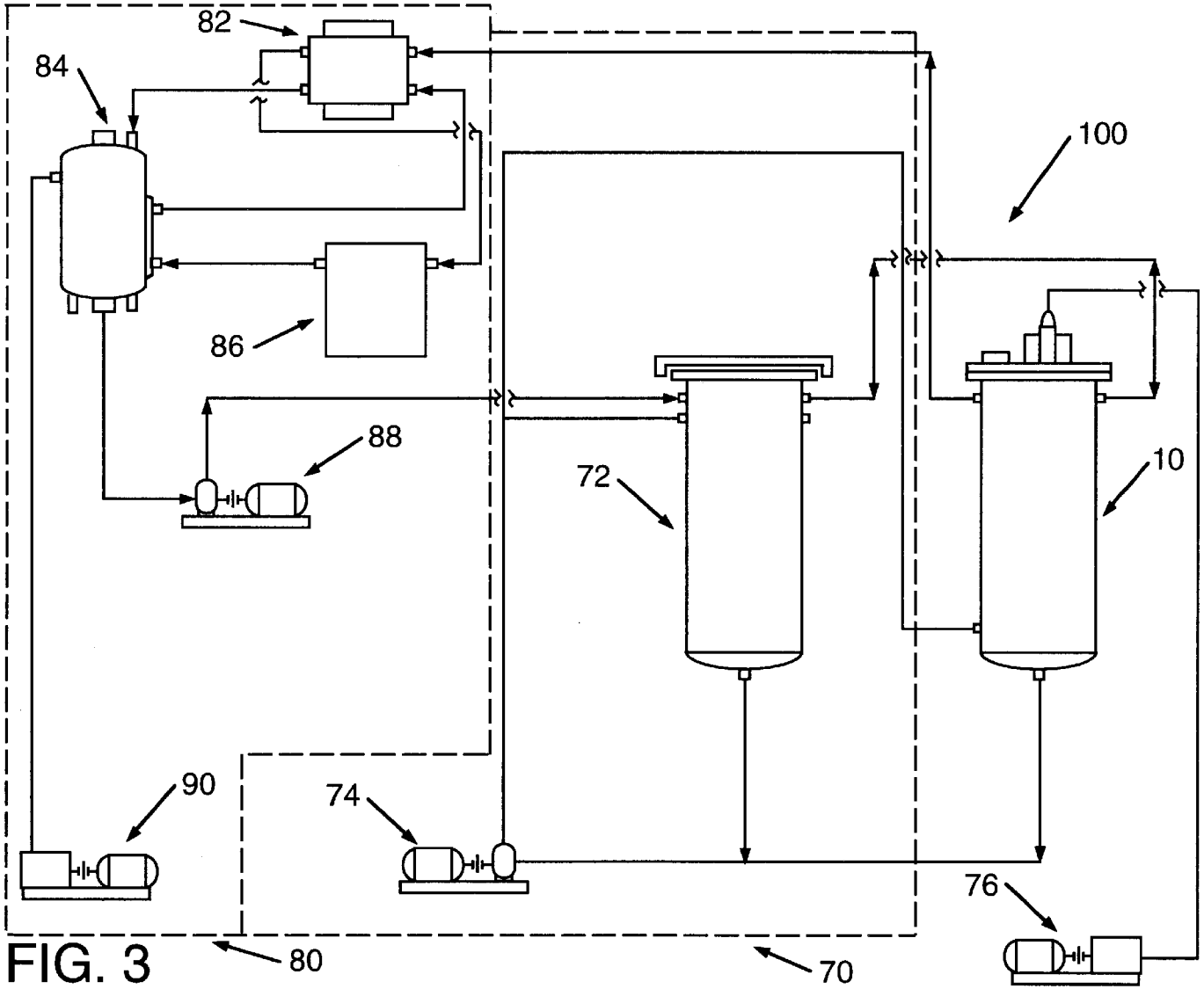
FIG. 3 is a schematic diagram of the deacidification system with a vacuum recycling system.
Figure 4:
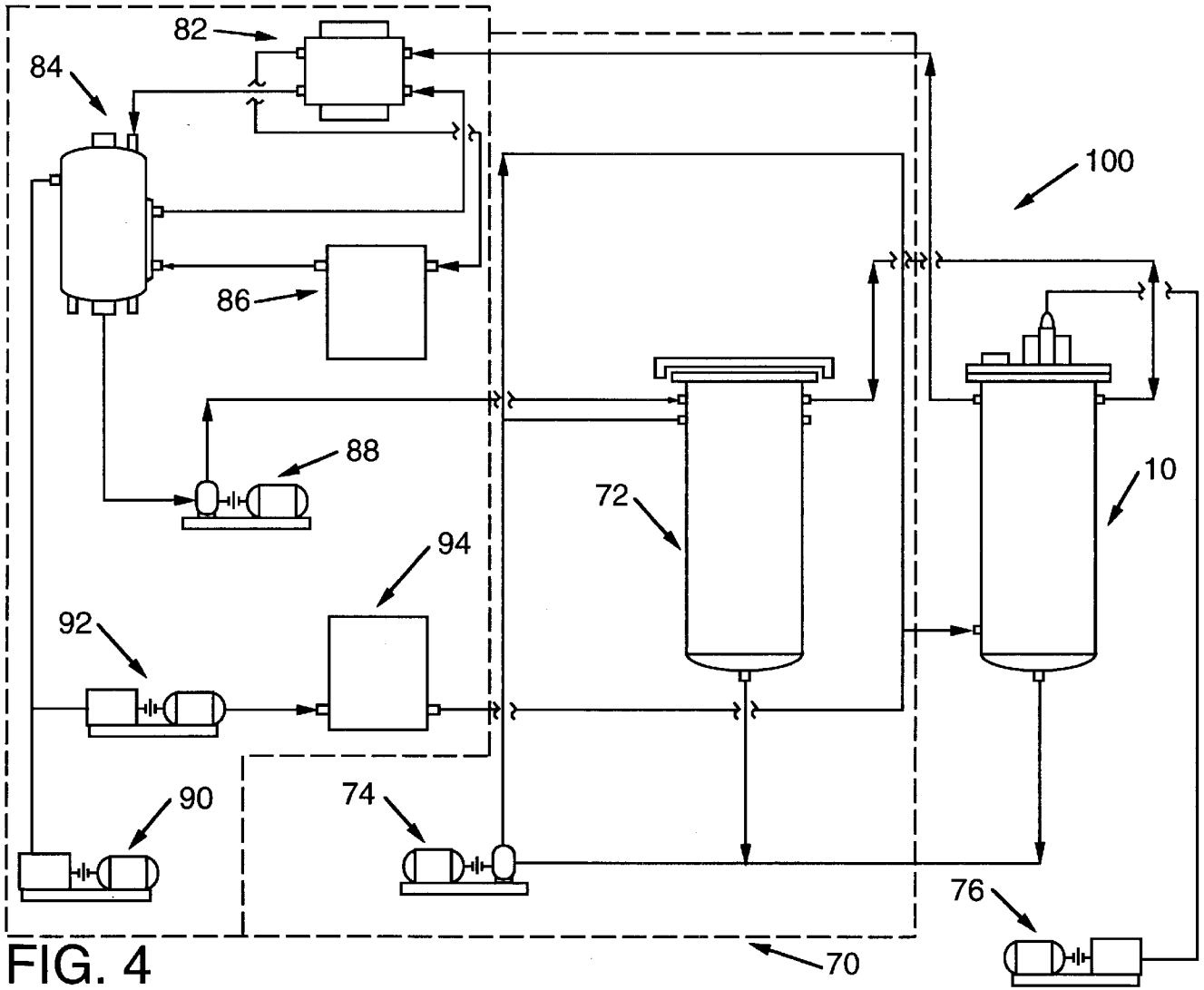
FIG. 4 is a schematic diagram of the deacidification system with a two stage gas circulation and vacuum recycling system.
Figure 5:
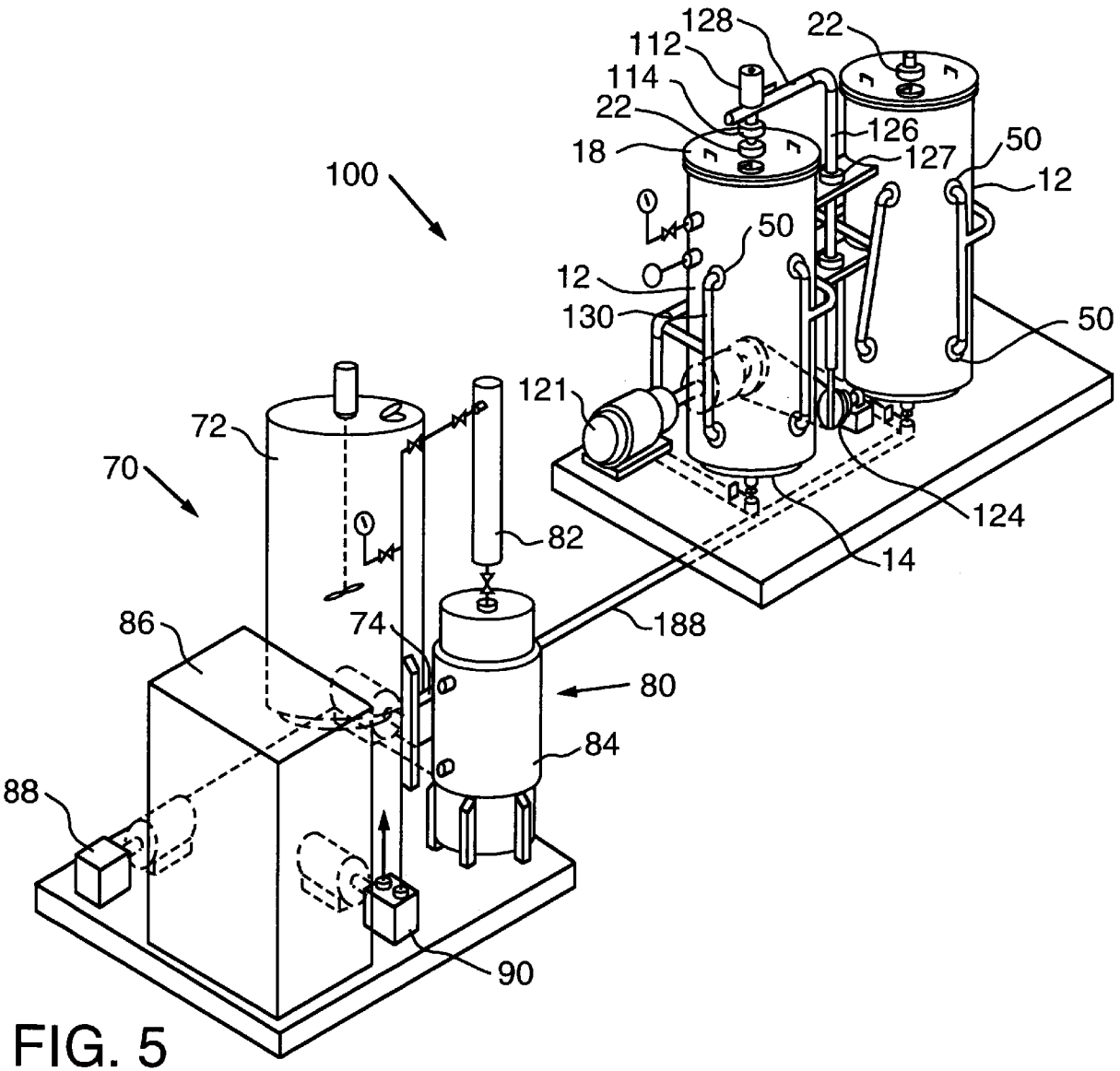
FIG. 5 is a perspective view of the treatment system of the present invention.

The preferred embodiments of treatment apparatus 10 of the present invention are shown in FIGS. 1 to 5. The operation of the treatment apparatus 10 will be described generally with reference to the drawings for the purpose of illustrating the present preferred embodiments of the invention only and not for purposes of limiting the same. Referring to FIG. 5, a treatment system is provided which includes at least one treatment apparatus 10 and a recovery system 70. The treatment apparatus 10 generally includes a tank 12, and material holders 40 disposed within the tank 12. Material 60 to be treated is secured in the material holders 40. Means are provided for moving the material holders 40 in a reciprocating and in a rotational manner and spray nozzles 50 are provided for directing a fluid treating medium toward the materials 60 in a direction generally perpendicular to the spine of the materials. The materials which are the primary focus of the invention as described herein are cellulose based materials which are bound or folded such that they have a spine or fold line joining opposing pages. As stated above, the area of the spine or fold line where the pages are connected to each other defines a gutter like area which heretofore has been difficult to completely deacidify. As used herein, the spine of the material means the spine of a bound book, booklet, pamphlet or the like, or the fold line of a magazine, newspaper or other folded document and the general area of the gutter adjacent thereto. While preferred embodiments of the apparatus 10 will be discussed with respect to deacidifying cellulose based material using one or two possible arrangements, those skilled in the art will appreciate that the invention can be suitably modified to adapt the treatment apparatus to suit a variety of specific treatment needs.

In a preferred embodiment, the tank 12 is cylindrically shaped and includes a tank bottom 14, tank wall 16 and a tank top or lid 18. The tank 12 is oriented in the Figures such that the central axis of the cylinder is disposed vertically. The tank may be oriented in a different direction. The tank wall 16 and the tank bottom are preferably constructed from stainless steel; however, any material of sufficient strength to withstand pressure differentials resulting from drawing a vacuum and that is suitably resistant to any reaction with the treatment chemicals would be acceptable. The tank lid 18 is removably sealable to the tank walls 16 by any conventional means, such as clamps 19 or bolts, and is preferably constructed of a lightweight, but structurally sturdy, plastic or metal, to enable the lid 18 to be easily removed to provide access to the interior of the tank 12. A cylindrically shaped tank 12 is preferred to minimize the overall volume of the tank 12, while providing adequate room for the movement of material handlers 40 within the tank 12. It will be appreciated that tank geometries other than a cylinder, such as a rectangular or annular shape, are suitable for use with the invention, as are open tank designs if containment of the treatment chemicals is not an issue.

A shaft 30 having a central axis and a first and a second end, 32 and 34, respectively, is used to position the material 40 within tank 12. The material holders 40, which are radially disposed about the material holder shaft 30, can be secured to the material holder shaft 30 at desired elevations through use of spacers 49 of varying heights; however, any conventional method of securing the holders 40 to shaft 30, such as clamping, would suffice. The material holders 40 are preferably in the form of partitions 44 on a fixed common ring shaped lower stop 46 slidably mounted on material holder shaft 30 and an adjustable upper stop 48. The partitions 44 are preferably positioned at 90° intervals to form four sections, each of which can hold a single book; however, those skilled in the art will appreciate that by changing the number of partitions 44 about the shaft 30 and the angles between the partitions 44, the number of holding sections in each material holder 40 can be changed as may be necessary for specific applications. The material holders 40 may also be perforated or constructed with open slats or webbing to provide an increased area of exposure to the treating medium.

Figure 2:
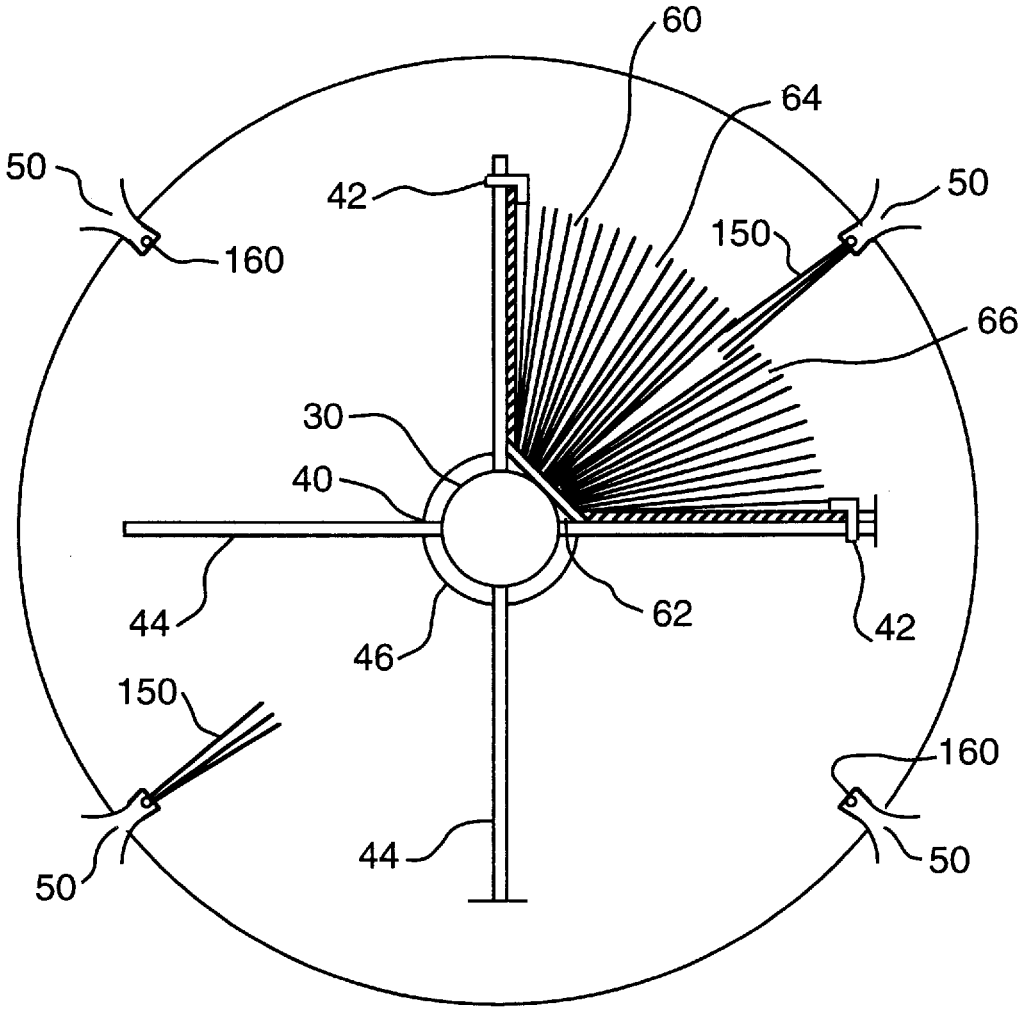
FIG. 2 is a top cross sectional view of the treatment apparatus of the present invention along the plane of the nozzles showing a book placed in one section of a book holder.

As shown in FIG. 2, the outside sheets or covers 66 of the materials 60 can be secured in the adjacent partitions 44 of material holders 40 by bands 42. The spine 62 of the material 60 is supported by a wire (not shown) connected between upper stop 48 and lower stop 46. Any other conventional method of securing the outermost sheets can be used in lieu of bands 42, such as clips. In a preferred embodiment, the materials 60 are secured such that the surfaces 66 of the sheets 64 and the spine 62 of materials 60 are substantially parallel to gravity and the sheets 64 of the material 60 extend freely radially out from the spine 62.

Figure 1:
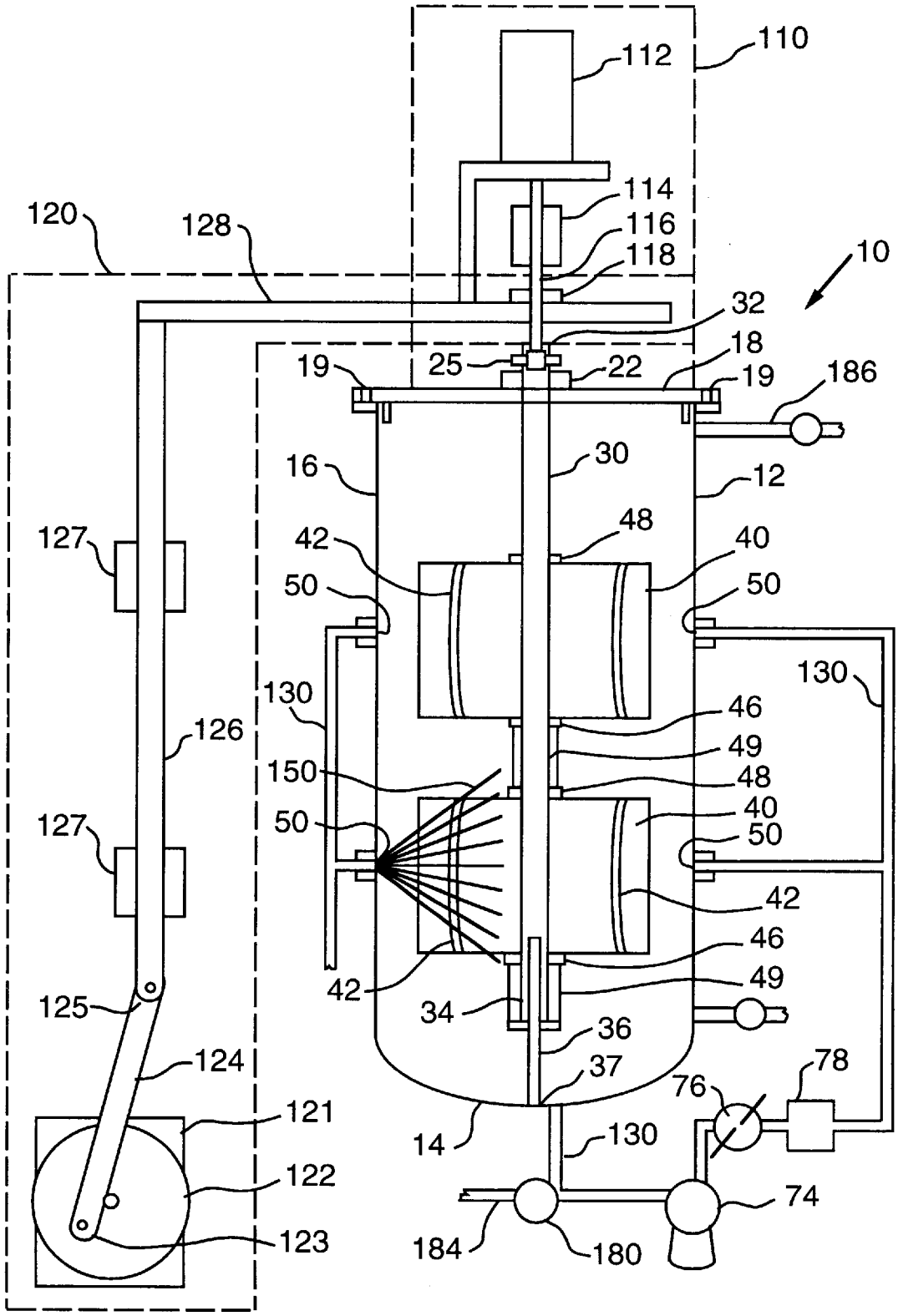
FIG. 1 is a side cross-sectional schematic view of a preferred embodiment of the treatment apparatus of the present invention with a top driven movement arrangement.

Referring to FIG. 1, a center support rod 36 passes through a vapor seal 22 in the tank lid 18 along the central axis of the tank 12 to operatively connect material holder shaft 30 and suitable drive mechanisms for imparting motion to the shaft 30. The lower end 37 of the center support rod 36 is mounted to the tank bottom 14 along the central axis of the tank 12 to support shaft 30. Alternatively, connections to the drive mechanisms can be provided at the other end or at both ends of the material holder shaft, 32 and 34. For example, the material holder shaft 30 may extend through a liquid/vacuum seal in the tank bottom 14 to operatively connect the shaft 30 to the drive mechanisms from the bottom. It will be appreciated by those skilled in the art that numerous alternative embodiments for imparting the desired motion to the material holders 40 via the material holder shaft 30 are within the scope of the invention.

Referring to FIG. 1, rotation and reciprocation of the material holders 40 are provided by a variable speed motor assembly 110 and a flywheel assembly 120, respectively, operatively attached to the first or upper end 32 of shaft 30 by a connecting rod 116 and locking pin 25. The variable speed motor assembly 110 includes a variable speed motor 112 that is mounted to the reciprocating arm 128 of the flywheel assembly and is attached via a coupling 114 to connecting rod 116. The connecting rod 116 passes through the reciprocating arm 128 of the flywheel assembly 120 and support bearing 118. Support bearing 118 supports the connecting rod 116, providing a linkage between the rotational mechanism and the reciprocating mechanism in such a way that rotational and reciprocal movement imparted to the rod 116 will be translated to the material holder shaft 30.

Reciprocation of the material holders 40 is provided by a flywheel assembly 120. A variable speed motor 121 is attached to a circular flywheel 122 to produce a circular motion. A first end 123 of the translation arm 124 is movably attached to the flywheel 122 at a point offset from the center of the flywheel to produce reciprocal movement of the translation arm 124 upon rotation of the flywheel 122. A drive arm 126 is connected at one end to the second end 125 of the translation arm 124 and at the other end to the reciprocating arm 128. Linear bearings 127 are used to stabilize and dampen any nonreciprocal movement of the drive arm 126. The movement produced by the flywheel assembly 120 serves to reciprocate both the material holders 40 mounted on shaft 30 and the variable speed motor assembly 110 The coupling of the flywheel assembly 120 and the variable speed motor assembly 110 produces a combined rotational and reciprocating movement of the materials 60 within tank 12 when they are held in the sections defined between partitions 44 of holders 40. When tank 12 is filled with treating medium, there is created relative movement between the material 60 and the treating medium that provides for better treatment and greater separation of the sheets of the material. The combination of the relative parallel movement and rotational movement can create a partial spiral or helical motion. However, in the preferred embodiment of the invention, the rotational motion is slow relative to the reciprocal motion so that the major character of the motion is linear, with a slight partial helical tendency For example, in a treatment period of 25 minutes, there are preferably two full rotations of shaft 30 about the axis of the tank 12 compared to a reciprocation rate for shaft 30 of 16 strokes per minute over a stroke length of 12 inches. The rotational motion and the reciprocal movement of the shaft 30 preferably occur simultaneously throughout the process, but may occur intermittently. The motor 110 can be turned on and off while the motor 121 reciprocates the shaft 30. Alternatively, motor 121 may be turned on and off while motor 110 rotates shaft 30.

Nozzles 50 are provided within tank 12 to direct recirculated treating medium toward the materials 60. The nozzles 50 are preferably radially mounted in the tank wall 16 at elevations corresponding to the relative location of the material holders 40. While the position, number and type of nozzles used in tank 12 can be varied by the skilled practitioner to achieve a desired result, it is preferred to mount four spray nozzles circumferentially at approximately 90° intervals at elevations corresponding to the number and at rest location of the material holders 40. Referring to FIG. 1, the treating medium is recirculated through line 130 from a drain in tank bottom 14 to the nozzles 50 by using pump 74. The recirculating treating medium is passed through heat exchanger 76 to provide control over the temperature of the treating medium and through an ultrasonic agitator or generator 78 to ensure adequate dispersion of the alkaline particles within the fluid carrier. A filter may also be disposed along line 130.

The rotation and reciprocation of the material holders 40 also serves to minimize the number of nozzles 50. The nozzles 50 are preferably structured with a vertical slit 160 to produce a generally flat vertically oriented spray 150 (see FIGS. 1 and 2) forming an arc of about 80°. This flat spray 150 is preferably directed at the gutter portion of the pages of the materials 60 as they rotate and reciprocate up and down past the spray 150. In a tank having a diameter of about 61 cm., it is preferably delivered at 1.5 gal./min. at 40 psi pressure. It has been found that this is an optimum rate and pressure for this size tank to avoid curling or folding the pages with the force of the spray while substantially enhancing the deacidification effected by the treating medium, particularly in the gutter portion of the pages. If the spray flow rate is too high, for example 3 gal./min., the pages curl and fold over. If the flow rate is too low, below 1 gal./min., the area of effective treatment, or deacidification, decreases. Those skilled in the art will recognize that the precise rate and pressure will vary depending on the size of tank 12 and the distance between the spray nozzles 50 and the materials 60. The important parameters are enhancing deacidification and avoiding curling and folding of the pages of the materials. The spray directs movement of the treating medium in a direction generally perpendicular to the spine 62 of the material 60 in conjunction with the relative parallel movement caused by the reciprocation and, when combined with the rotational movement, a slight spiral or helical movement of the materials through the treating medium. The primary purpose of the rotational motion is to move the materials slowly past the spray. The spray preferably occurs simultaneously with the other movement of the materials 60 throughout the treatment period, but may be intermittent. The timing can be controlled by opening and closing a drain in the bottom of tank 12 and a suitable valve to line 130.

It is believed that the force exerted by the spray perpendicular to the spine 62 of the materials forces the pages at the problematic gutter area to open more than they otherwise would and thereby permits greater exposure of the page to the treating medium as the materials follow their reciprocating linear or helical path through the treating medium. As described in the '147 patent to Leiner et al., relevant portions of which are incorporated herein by reference, the materials 60 may remain stationary, and the treating medium may be caused to flow by appropriate lines, valves and pumps, through the tank 12 over the materials 60 in a direction substantially parallel to the spine 62 of the materials. Alternatively, the materials may rotate while the treating medium flows through the tank and is simultaneously sprayed as described above.

As shown in FIGS. 3–5, a closed treatment system 100 for the treatment of materials 60 includes a plurality of treatment apparatuses 10 of the present invention (two are shown), a recirculation/storage system 70, and a recycling system 80. A current preferred embodiment of the closed system 100 provides for the use of a recirculating/mixing system 70 including a storage/mix tank 72 and a recirculating pump 74 attached to the treatment apparatus 10. In a preferred embodiment of treatment apparatus 10, the recirculating pump 74 connects the storage/mix tank 72 with the nozzles 50. The physical location of outlet port 22 in tank 12 is dependent upon whether the fluid treating medium is vapor or liquid. One skilled in the art will appreciate that it is within the scope of the present invention to provide additional recirculation/storage tanks 72, recirculating pumps 74 and treatment apparatuses 10 within the same operating loop or in additional loops to achieve the desired capacity and to optimize facility usage.

A recycling system 80 is attached to the treatment apparatus 10 to provide for the recovery of the residual treating medium to be removed from the material 60 following the transfer of the bulk treating medium from the treatment apparatus 10 to the storage/mix tank 72. The specific recovery system 80 necessary for a specific application will necessarily depend, in part, on the treating medium used in the process, but for liquid treating medium, the system may generally include a condenser 82, a recovery tank 84, a heat exchanger 86, a recirculating pump 88 and a vacuum pump 90. A current preferred recovery system for liquid treating medium includes a two stage dryer further including a blower 92 and heat exchanger 94 connected to treatment apparatus 10 to provide for reduced drying times and increased process efficiency.

In the practice of the present invention in the context of the aforementioned preferred embodiment, the tank lid 18 and material holders 40 including material holder shaft 30 and spacers 49 are removed from tank 12. Materials 60 are seated on the material holder lower stop 46, upper stop 48 is seated on the top of the material 60 and a retaining wire is strung between lower stop 46 and upper stop 48 across the spine 62 to hold the material 60 in place. The outermost sheets or cover 64 of material 60 are secured in material holders 40 using bands 42, such that the sheets 64 extend radially from spine 62 and the inner circle of lower-stop 46. The material holders 40 are slid onto the material holder shaft 30 and are positioned at the different elevations using spacers 49. The shaft 30 with holders 40 in place is positioned in tank 12 such that the second end 34 of material holder shaft 30 seats upon and engages the center support rod 36. Tank top 18 is secured to the tank wall 16 using clamps 19. The treating medium is introduced into tank 12 via line 188 to fill the tank to a level which will submerge the materials 60 throughout the process. Then, the treating medium is recirculated through nozzles 50 via line 130 resulting in substantially perpendicular flow relative to the spine 62 of the material 60 from the spray 150, during which time the shaft 30 and holders 40 are rotated and reciprocated to provide relative movement in all three dimensions. The relative movement allows the treating medium to separate the sheets 64 of the material 60, thereby providing greater access of the treating medium to the spine 62 of the material 60. The rotational motion of the material holders 40 past the radially spaced nozzles 50 serves to separate the sheets 64 at the gutter region providing greater access to the treating medium. The materials 60 are expose for a period of time sufficient to expose substantially the entire surfaces 66 of the materials 60 in each of the material holders 40 to an effective amount of the treating medium to neutralize the acidic species present in the cellulosic materials 60 and deposit an alkaline buffer. The bulk treating medium is then removed from tank 12. The valve 180 is positioned to block flow to nozzles 50 and instead direct flow through line 184 to a holding tank or a second tank 12 in a multi-tank system. The excess treating medium remaining in the materials 60, if any, is removed using either forced heated air or vacuum drying in the tank 12. An exhaust line 186 is provided for escape of vapors

EXAMPLES

An extensive series of tests was performed comparing the extent of deacidification resulting from the new apparatus and method using a spray of treating medium directed in a general perpendicular direction toward the spine of the books tested to an apparatus and method without the spray. The comparison was performed using a vertically oriented cylindrical tank with the spine of the books oriented substantially parallel to gravity and using a treating medium consisting of perfluoroalkane as an inert treatment carrier and perfluoropolyoxyether alkanoic acid as a surfactant and dispersed $MgO_2$ particles having an average diameter of approximately 0.8 microns as the treatment species as described in the Leiner '736 patent, relevant portions of which are incorporated herein by reference. In one technique, the material holders were reciprocated over a stroke length of approximately twelve inches at a rate of 16 cycles/minute and the treating medium was bulk circulated for a period of 25 minutes. No spray was used.

In the technique of the present invention, the material holders were reciprocated over a stroke length of approximately twelve inches at a rate of 16 cycles/minute. A portion of the treating medium was recirculated and reintroduced to the tank through the spray nozzles 50 as described above. The material holders were rotated two full revolutions during the 25 minute exposure. The length of the treatment is determined by the percentage of alkaline reserve that one wants to deposit. The 25 minute exposure time has been found to be sufficient to deposit an alkaline reserve equivalent to 1.5% $CaCO_3$, which is the standard set by the United States Library of Congress. Following the treatment, the bulk treating medium was drained from the tank and the books dried to remove excess treatment carrier that was retained in the pages. Tests were performed on 160 books using the nonspray technique and 111 books using the spray technique of the present invention to determine the extent of the untreated areas. The data shown below represents the most favorable data set in terms of the minimum average amount of untreated area from tests using the nonspray technique and is compared with the least favorable data set and the most favorable data set from tests using the spray technique of the present invention. Following treatment, select pages of the books treated were tested with a pH indicator, chlorophenol red. Alkaline areas produce a purple color and acidic areas produce a yellow color. In the data below, column 2 represents the area of the entire page tested in height (top number) and width (bottom number). Columns 3 to 7 show the height (top number) and the width at the widest point (bottom number) of yellow areas on the treated pages. The acidic areas generally form triangles, with the height extending the length of the spine and the width generally in the center of the page. The untreated areas shown in column 8 was calculated by assuming that each untreated area is an equilateral triangle of the dimensions set forth in columns 2 to 7 and dividing by the total area of the page to get the percent average untreated area.

TABLE I

| | | Treatment Without Spray | | | | | |
|---|---|---|---|---|---|---|---|
| Book No. 1 | Page Size (inches) 2 | Center of the book −100 Pages 3 | Center of the book −50 Pages 4 | Center of the book 5 | Center of the book +50 Pages 6 | Center of the book +100 Pages 7 | Average Untreated Area % 8 |
| 65 | 7 (H) | 7 (H) | 6.2 (H) | 7 (H) | 7 (H) | 0 (H) | 6.2 |
| | 4.2 (W) | 0.8 (W) | 0.7 (W) | 0.7 (W) | 0.5 (W) | 0 (W) | |
| 66 | 7.7 | 4.3 | 2 | 2 | 6 | 0 | 0.9 |
| | 5.3 | 0.1 | 0.5 | 0.3 | 0.3 | 0 | |
| 67 | 8 | 8 | 6 | 3 | 8 | 8 | 5.0 |
| | 5.5 | 0.6 | 0.7 | 0.1 | 0.7 | 0.9 | |

TABLE I-continued

| | | Treatment Without Spray | | | | | |
|---|---|---|---|---|---|---|---|
| Book No. 1 | Page Size (inches) 2 | Center of the book −100 Pages 3 | Center of the book −50 Pages 4 | Center of the book 5 | Center of the book +50 Pages 6 | Center of the book +100 Pages 7 | Average Untreated Area % 8 |
| 68 | 7.5 | 6 | 5 | 6 | 7 | 3 | 4.5 |
| | 5.3 | 0.7 | 0.4 | 0.9 | 0.6 | 0.7 | |
| 69 | 8.2 | 7 | 8 | 0 | 7 | 7 | 6.8 |
| | 5.5 | 0.8 | 1.3 | 0 | 1.7 | 0.4 | |
| 70 | 8.5 | 0 | 0 | 7 | 5.2 | 0 | 0.7 |
| | 5.5 | 0 | 0 | 0.1 | 0.5 | 0 | |
| 71 | 7.5 | 7 | 7 | 7 | 6 | 6 | 5.6 |
| | 5.5 | 0.8 | 0.9 | 0.6 | 0.7 | 0.5 | |
| 72 | 7.8 | 7 | 0 | 7 | 7 | 0 | 7.2 |
| | 5.2 | 1.2 | 0 | 1.8 | 1.2 | 0 | |
| 73 | 7.2 | 6 | 6 | 7 | 7 | 2 | 9.1 |
| | 4.5 | 0.3 | 1 | 0.4 | 2.6 | 0.4 | |
| 74 | 8.5 | 5.5 | 6.5 | 0 | 7.5 | 6 | 10.4 |
| | 5.8 | 1.2 | 2 | 0 | 2.8 | 1.8 | |
| 75 | 8.3 | 0 | 0 | 0 | 0 | 0 | 0.0 |
| | 5.5 | 0 | 0 | 0 | 0 | 0 | |
| 76 | 8.3 | 0 | 0 | 3 | 8 | 8 | 3.5 |
| | 5.5 | 0 | 0 | 0.6 | 1.1 | 0.7 | |
| 77 | 9.4 | 0 | 0 | 8 | 9 | 6 | 1.6 |
| | 7.3 | 0 | 0 | 0.3 | 0.9 | 0.1 | |
| 78 | 9.8 | 7 | 9 | 10 | 9 | 9 | 4.9 |
| | 6.5 | 0.1 | 1.1 | 0.9 | 0.7 | 0.6 | |
| 79 | 9.6 | 0 | 9 | 0 | 6 | 9 | 3.0 |
| | 7.4 | 0 | 1.1 | 0 | 1.2 | 0.5 | |
| 80 | 9.8 | 0 | 6 | 10 | 10 | 10 | 5.3 |
| | .7 | 0 | 0.7 | 1.6 | 0.5 | 1.1 | |
| 81 | 9.3 | 9 | 7 | 0 | 6 | 0 | 2.2 |
| | 8.1 | 0.8 | 0.6 | 0 | 0.9 | 0 | |
| 82 | 8.3 | 0 | 7 | 8 | 8 | 0 | 2.8 |
| | 5.4 | 0 | 0.1 | 0.5 | 1 | 0 | |
| 83 | 8 | 4 | 8 | 0 | 6 | 0 | 3.2 |
| | 5.2 | 0.3 | 1.2 | 0 | 0.4 | 0 | |
| 84 | 8.1 | 0 | 8 | 8 | 0 | 6 | 4.6 |
| | 5.4 | 0 | 1.2 | 1 | 0 | 0.4 | |
| 85 | 7.5 | 2 | 7 | 7 | 7 | 7 | 11.7 |
| | 5.4 | 0.6 | 1.8 | 1.9 | 1.1 | 1.8 | |
| 86 | 8 | 7 | 8 | 8 | 8 | 6 | 8.8 |
| | 5.2 | 0.9 | 0.2 | 1.2 | 1.4 | 1.3 | |
| 87 | 7.2 | 7 | 5 | 0 | 5 | 0 | 2.0 |
| | 4.8 | 0.4 | 0.3 | 0 | 0.5 | 0 | |
| 88 | 7.2 | 4 | 7 | 7 | 7 | 3 | 6.4 |
| | 4.8 | 0.4 | 0.9 | 1.1 | 0.9 | 0.1 | |
| 89 | 10 | 9 | 10 | 9 | 10 | 7 | 10.2 |
| | 6.5 | 1 | 1.1 | 1 | 3.1 | 0.9 | |
| 90 | 9 | 9 | 9 | 9 | 4 | 9 | 7.5 |
| | 6 | 0.9 | 1.3 | 1.4 | 0.7 | 0.6 | |
| 91 | 9 | 0 | 9 | 9 | 9 | 0 | 1.0 |
| | 6 | 0 | 0.2 | 0.2 | 0.2 | 0 | |
| 92 | 8 | 4 | 0 | 8 | 7 | 0 | 1.7 |
| | 5.1 | 0.1 | 0 | 0.2 | 0.7 | 0 | |
| 93 | 8 | 8 | 8 | 0 | 8 | 0 | 5.7 |
| | 5.3 | 0.9 | 1 | 0 | 1.1 | 0 | |
| 94 | 8 | 4 | 8 | 0 | 8 | 7 | 3.9 |
| | 5.3 | 0.3 | 1 | 0 | 0.4 | 0.6 | |
| 95 | 8 | 0 | 0 | 0 | 8 | 0 | 1.3 |
| | 5.3 | 0 | 0 | 0 | 0.7 | 0 | |
| 96 | 8.1 | 4 | 8 | 0 | 0 | 3 | 1.3 |
| | 5.5 | 0.1 | 0.6 | 0 | 0 | 0.2 | |

TABLE II

| | | Treatment with Spray | | | | | |
|---|---|---|---|---|---|---|---|
| Book No. 1 | Page Size (inches) 2 | Center of the book −100 Pages 3 | Center of the book −50 Pages 4 | Center of the book 5 | Center of the book +50 Pages 6 | Center of the book +100 Pages 7 | Average Untreated Area % 8 |
| 1005 | 8.2 (H) | 0 (H) | 0 (H) | 4.2 (H) | 5.6 (H) | 0 (H) | 0.2 |
| | 5.3 (W) | 0 (W) | 0 (W) | 0.1 (W) | 0.1 (W) | 0 (W) | |
| 1006 | 8.6 | 0 | 0 | 4.2 | 5.6 | 0 | 0.2 |
| | 5.7 | 0 | 0 | 0.1 | 0.1 | 0 | |
| 1007 | 9.3 | 0 | 0 | 0 | 0 | 0 | 0.0 |
| | 6.2 | 0 | 0 | 0 | 0 | 0 | |
| 1008 | 9.2 | 0 | 0 | 0 | 0 | 0 | 0.0 |
| | 6.1 | 0 | 0 | 0 | 0 | 0 | |
| 1009 | 9.2 | 0 | 0 | 0 | 0 | 0 | 0.0 |
| | 6.1 | 0 | 0 | 0 | 0 | 0 | |
| 1010 | 9.4 | 3.8 | 2.6 | 0 | 0 | 3 | 0.2 |
| | 6.3 | 0.2 | 0.05 | 0 | 0 | 0.1 | |
| 1011 | 9.5 | 0 | 0 | 2.8 | 4 | 0 | 0.1 |
| | 7.2 | 0 | 0 | 0.05 | 0.1 | 0 | |
| 1068 | 7.4 | 0 | 5.6 | 4 | 4.9 | 4.5 | 1.9 |
| | 5 | 0 | 0.05 | 0.9 | 0.3 | 0.4 | |
| 1069 | 8.7 | 0 | 0 | 5.5 | 4.9 | 6 | 0.5 |
| | 5.5 | 0 | 0 | 0.1 | 0.1 | 0.2 | |
| 1070 | 8.2 | 0 | 7 | 6.7 | 5.8 | 0 | 2.4 |
| | 5.5 | 0 | 0.7 | 0.8 | 0.1 | 0 | |
| 1071 | 8.4 | 3.1 | 1.6 | 6 | 5.4 | 5.4 | 1.2 |
| | 5.7 | 0.2 | 0.2 | 0.3 | 0.1 | 0.5 | |
| 1072 | 8.5 | 3.5 | 6 | 6 | 4.8 | 5.8 | 1.5 |
| | 5.6 | 0.2 | 0.05 | 0.5 | 0.4 | 0.2 | |
| 1073 | 8.5 | 3.2 | 5.7 | 5 | 6 | 5.9 | 1.9 |
| | 5.5 | 0.7 | 0.3 | 0.6 | 0.1 | 0.2 | |
| 1074 | 8.5 | 4.8 | 3.2 | 4 | 5.8 | 5.7 | 2.0 |
| | 5.6 | 0.3 | 1.2 | 0.8 | 0.1 | 0.05 | |
| 1075 | 9 | 3.2 | 4.2 | 5.7 | 4.8 | 5.2 | 0.9 |
| | 5.8 | 0.2 | 0.2 | 0.3 | 0.2 | 0.1 | |

For all of the test runs, the average untreated area in the books treated without the spray was approximately 4.7%, as compared with the average of ~0.4% for the books treated with the spray by the method and in the apparatus of the present invention. The data evidence the surprising marked improvement achievable with the use of the apparatus and method of the present invention. The combination of the relative movement between the materials and the treating fluid in a direction parallel to the spine of the materials and the flow of treating fluid directed in a generally perpendicular direction toward the spine of the materials provides unexpected level of improvement in the percentage of area deacidified in the problematic gutter region of the materials.

Although the present invention has been described primarily in conjunction with books, the method and apparatus may be used with other types of cellulosic material such as magazines, newspaper, maps, documents and the like, whether folded, bound or loose. Those of ordinary skill in the art will appreciate the fact that there are a number of modifications and variations that can be made to specific aspects of the method and apparatus of the present invention without departing from the scope of the present invention. Such modifications and variations are intended to be covered by the foregoing specification and the following claims.

What is claimed is:

1. A method for contacting sheetlike material having opposing surfaces and defining a spine with a treating medium comprising placing the material in a treating medium;

producing relative movement at a predetermined velocity between the materials and the treating medium in a direction generally parallel to the spine of the materials for a period of time effective for the treating medium to contact substantially all of the material;

directing the treating medium toward the materials generally perpendicular to the spine of the materials sufficient to expose substantially the entirety of the spine of the materials to the treating medium for a period of time effective for the treating medium to contact substantially all of the material; and, removing excess treating medium from the material.

2. The method of claim 1 wherein the treating medium comprises treating species for deacidifying the materials.

3. The method of claim 1 wherein said step of producing movement in a direction generally parallel to the spine of the materials comprises placing the materials in a tank and flowing treating medium over the materials in a direction generally parallel to the spine of the materials.

4. The method of claim 1 wherein said step of producing movement in a direction generally parallel to the spine of materials comprises submerging the materials in a tank containing a volume of treating medium;

moving the materials through the treating medium in a direction parallel to the spine of the materials.

5. The method of claim 4 wherein the step of moving the materials through the treating medium in a direction parallel to the spine of the materials comprises reciprocating the materials in said parallel direction.

6. The method of claim 1 wherein said step of directing the treating medium toward the material in a direction generally perpendicular to the spine of the material comprises spraying treating medium towards said materials from spray nozzles disposed in a tank and positioned in a facing relationship relative to the materials.

7. The method of claim 6 further comprising directing the spray in a generally flat arcuate pattern such that the spray is generally parallel to the spine of the materials.

8. The method of claim 7 wherein the spray is directed at a rate within the range of about 1.0 to less than 3.0 gallons per minute.

9. The method of claim 6 wherein said step of spraying occurs simultaneously with said step of moving the materials in a direction parallel to the spine of the materials.

10. The method of claim 9 further comprising rotating said materials during said step of moving the materials in a direction parallel to the spine of the materials to produce a partial helical motion.

11. The method of claim 4 further comprising rotating said materials during said step of moving the materials in a direction parallel to the spine of the materials to produce a partial helical motion.

12. The method of claim 1 wherein the step of producing relative movement in a direction generally parallel to the spine of the materials and the step of exerting pressure against the material occur simultaneously for at least a portion of said period of time.

13. The method of claim 1 further comprising producing relative movement between the treating medium and the materials in a generally arcuate direction relative to the spine of the materials.

14. A method for contacting sheetlike material having opposing surfaces and defining a spine with a treating medium comprising:

placing the material in a treating medium;

producing relative movement at a predetermined velocity between the materials and the treating medium in a direction generally parallel to the spine of the materials for a period of time effective for the treating medium to contact substantially all of the material; and, directing the treating medium toward the material in a direction generally perpendicular to the spine of the material for a period of time effective for the treating medium to contact substantially all surfaces of the material.

* * * * *

UNITED STATES PATENT AND TRADEMARK OFFICE

CERTIFICATE OF CORRECTION

PATENT NO. : 5,770,148
DATED : June 23, 1998
INVENTOR(S) : Leiner et al.

It is certified that error appears in the above-identified patent and that said Letters Patent is hereby corrected as shown below:

Abstract,
Line 17, delete "material" and substitute therefor -- materials --;

Column 1,
Line 39, delete "an" and substitute therefor -- and --;
Line 43, delete "a" and substitute therefor -- as --;

Column 2,
Line 31, delete "are" and substitute therefor -- area --;

Column 6,
Line 4, after "material" insert -- holders --;

Column 7,
Line 13, after "110" insert -- . --; and

Column 9,
Line 34, delete "expose" and substitute therefor -- exposed --.

Signed and Sealed this

Second Day of October, 2001

*Attest:*

Nicholas P. Godici

*Attesting Officer*

NICHOLAS P. GODICI
*Acting Director of the United States Patent and Trademark Office*